US006672484B2

(12) United States Patent
Newing et al.

(10) Patent No.: US 6,672,484 B2
(45) Date of Patent: Jan. 6, 2004

(54) INTEGRATED HEAT EXCHANGER AND LIQUID DISPENSING UNIT

(75) Inventors: Paul Newing, North Freemantle (AU); Andrew Hunter, North Freemantle (AU)

(73) Assignee: Matilda Bay Brewing Co. Limited (AU)

( * ) Notice: Subject to any disclaimer, the term of this patent is extended or adjusted under 35 U.S.C. 154(b) by 0 days.

(21) Appl. No.: 10/087,597

(22) Filed: Mar. 1, 2002

(65) Prior Publication Data

US 2003/0029883 A1 Feb. 13, 2003

Related U.S. Application Data

(63) Continuation of application No. PCT/AU00/01035, filed on Sep. 1, 2000.

(30) Foreign Application Priority Data

Sep. 2, 1999 (AU) ..... PQ2632

(51) Int. Cl.[7] ..... B67D 5/62

(52) U.S. Cl. ..... 222/146.1; 222/146.6; 222/129.1; 222/132; 62/389; 62/390

(58) Field of Search ..... 222/146.6, 146.1, 222/146.2, 132, 131, 129.1, 129; 62/389, 390, 393

(56) References Cited

U.S. PATENT DOCUMENTS

| | | | | | |
|---|---|---|---|---|---|
| 1,077,016 | A | * | 10/1913 | Turek | 62/399 |
| 2,010,060 | A | * | 8/1935 | Copeman | 62/98 |
| 2,091,755 | A | * | 8/1937 | Fleshman | 62/390 |
| 2,118,724 | A | * | 5/1938 | Christo | 62/264 |
| 2,199,503 | A | * | 5/1940 | Martin | 62/393 |
| 2,292,692 | A | * | 8/1942 | Huber | 62/393 |
| 2,339,082 | A | * | 1/1944 | Kromer | 137/209 |
| 2,342,299 | A | | 2/1944 | Peet | 225/40 |
| 3,696,636 | A | * | 10/1972 | Mille | 62/399 |
| 3,998,070 | A | * | 12/1976 | Mueller | 62/393 |
| 4,730,463 | A | | 3/1988 | Stanfill | 62/399 |
| 5,343,716 | A | * | 9/1994 | Swanson et al. | 62/389 |
| 5,694,787 | A | * | 12/1997 | Cleleand et al. | 62/396 |
| 5,743,107 | A | * | 4/1998 | Kyees | 62/390 |
| 6,487,873 | B2 | * | 12/2002 | Kyees | 62/390 |

FOREIGN PATENT DOCUMENTS

| | | | | |
|---|---|---|---|---|
| AU | A-79 047/81 | | 6/1983 | B67D/5/62 |
| GB | 2179129 | | 2/1987 | F25D/17/02 |
| GB | 2204670 | | 11/1988 | F25D/17/02 |
| GB | 2323153 | | 9/1998 | B67D/1/08 |
| GB | 2323433 | | 9/1998 | B67D/1/08 |
| GB | 2327748 | | 2/1999 | B67D/1/08 |
| IE | WO97/35155 | * | 9/1997 | F25D/31/00 |
| JP | 57014179 | | 1/1982 | |
| WO | WO-95/33968 | | 12/1995 | F28D/7/02 |
| WO | WO-01/17895 | | 3/2001 | B67D/5/62 |

* cited by examiner

*Primary Examiner*—Gene Mancene
*Assistant Examiner*—Frederick C. Nicolas
(74) *Attorney, Agent, or Firm*—Schwegman, Lundberg, Woessner & Kluth, P.A.

(57) ABSTRACT

An integrated heat exchanger and liquid dispensing unit 10 for flash cooling beer includes a main body 12 provided with an internal flow path 14 having an inlet 16, an outlet 18, and a void 20 in fluid communication therebetween. The void 20 is formed from four cylindrical chambers 22*a*–22*d* that are interlinked so as to be in mutual fluid communication with each other. Chambers 22 are formed in a thermal insulating block 26 held within the main body 12. Conduits 30*c*–30*d* are disposed within chambers 22*a*–22*d* respectively. Each conduit has an inlet 32 and an outlet 34. The outlet 34 is connected directly to a dispensing tap 36. The heat transfer fluid 45 passes through the fluid flow path 14 and thus flows through and about the conduits 30. Beer enters through inlet 32, passes through the conduit 30 and is dispensed through tap 36. The beer is cooled by virtue of a heat exchange with the fluid 45 flowing through the chambers 22.

42 Claims, 4 Drawing Sheets

INTEGRATED HEAT EXCHANGER AND LIQUID DISPENSING UNIT

CROSS-REFERENCE TO RELATED APPLICATIONS

This application is a continuation under 35 U.S.C. 111(a) of International Application No. PCT/AU00/01035 filed Sep. 1, 2000 and published in English as WO 01/17895 A1 on Mar. 15, 2001, which claimed priority from Australian Application No. PQ 2632 filed Sep. 2, 1999, which applications are incorporated herein by reference.

FIELD OF THE INVENTION

The present invention relates to an integrated heat exchanger and liquid dispensing unit, and in particular, but not exclusively, to a heat exchanger and liquid dispensing unit for the flash cooling and dispensing of beer.

BACKGROUND OF THE INVENTION

The cooling and dispensing of draught beverages such as beer requires the use of a refrigeration or cooling system to cool the beverage from room temperature to a preferred serving temperature. In relation to beer, a typical system used would involve a cool room for holding a supply of a refrigerant liquid such as brine and channelling the brine to a heat exchanger or flash unit disposed beneath a serving bar. Beer is channelled from one or more kegs held in a store room to the flash unit held beneath the bar. Often more than one beer is dispensed and there would be more than one dispensing point along the bar. The flash unit is typically in the form of a block of conductive material such as aluminium provided with a coolant coil through which the brine flows. Adjacent the cooling coil is one or more beer coils. An outlet from each beer coil is attached via a riser line to a font that is attached to the top of the bar. The font is in the form of a metallic T piece housing a plurality of internal pipes for channelling the beer to one or more taps connected to a cross bar of the font. The simultaneous passing of the brine and the beer through the flash unit transfers heat from the beer to the brine via the material of the block thereby cooling the beer. The flash unit may supply beer to more than one font.

This system for cooling beer has several inherent disadvantages. The heat exchanger or flash unit is of relatively large size and occupies substantial space beneath the bar. Further, the riser lines leading from the flash unit to the font, while insulated, absorb heat and thus increase the temperature of the beer previously passed through the flash unit. Also because of the volume of beer held in the riser lines, it is known if there is any substantial delay between the pouring of successive beers, that the third beer would be the coolest or at the optimum temperature. This sometimes leads to the practice of discarding the first glass or two of beer poured from each tap each day. Additionally the fonts, made from metal, act as a heat exchanger absorbing heat from the atmosphere. The amount of heat gained is substantial and is taken into consideration when designing cooling systems. The existence of the riser lines and fonts makes mechanical or abrasive cleaning of the beer lines beyond the flash unit virtually impossible. While abrasive cleaners are typically used from the keg to the flash unit, it is practically impossible to use such cleaners through the risers and fonts due to the relatively large number of diameter changes, elbows, and joints in the riser lines.

SUMMARY OF THE INVENTION

The present invention was developed to provide a beer dispensing system that substantially eliminates at least one of the abovementioned problems in the prior art. However, embodiments of the invention can be utilised for dispensing of different beverages or liquids and, for heating rather than cooling of the liquid to be dispensed.

According to one aspect of the present invention there is provided an integrated heat exchanger and liquid dispensing unit for the flash cooling or heating and dispensing of a liquid, said unit including at least:

- a main body including a block of thermal insulating material, the main body having an internal fluid flow path having an inlet, an outlet and a void disposed in fluid communication between said inlet and said outlet said void being formed in said block;
- a conduit, at least a length of which is disposed in said void, said conduit having an inlet to admit a liquid into said conduit and an outlet at an end of said length to expel the liquid; and,
- a dispensing valve coupled to said outlet of said conduit and supported on said main body for dispensing said liquid; whereby, in use, a heat transfer fluid is passed through said fluid flow path and directly contacts said length of said conduit to effect heat transfer between said heat transfer fluid and a liquid passing through said conduit, changing the temperature of said liquid while said liquid is dispensed directly from the main body via the dispensing valve.

Preferably said main body further includes an outer housing which houses the thermal insulating block and wherein the dispensing valve is demountably attached to said housing.

Preferably said void is lined with a rigid sleeve.

Preferably said unit includes an adaptor attached between said sleeve and said outer housing for coupling the outlet of said conduit to said dispensing valve.

Preferably said void includes a plurality of chambers, said chambers being in mutual fluid communication with each other so that said heat transfer fluid admitted through the inlet of the fluid flow path must flow through all of said chambers to exit through the outlet of said fluid flow path and said conduit is one of a plurality of separate conduits, each conduit having a length disposed in a corresponding chamber.

Preferably each chamber is lined with a separate rigid sleeve.

Preferably said length of each conduit is coiled.

Preferably said main body has a base on which said unit sits when said unit is in use.

Preferably said inlet and outlet of said fluid flow path and said inlets of conduits extend through said base.

Preferably said fluid flow path is a single non-branched flow path whereby all of said heat transfer fluid flowing into said inlet of said fluid flow path flows through said void and flows out said outlet of said fluid flow path.

Preferably said fluid flow path is free of valves or control means for controlling a rate of flow of said heat transfer fluid through said fluid flow path.

According to a further aspect of the present invention there is provided a liquid dispensing system including at least:

- an integrated heat exchanger and liquid dispensing unit according to the first aspect of the present invention, said main body having a base; and
- a substantially planar support surface on which said base sits and from which said liquid can be served.

Preferably said inlet and outlet of said fluid flow path and said inlet of said conduit extend through said base, and said planar support surface is provided with one or more apertures through which said inlet and outlet of said fluid flow path and said inlet of said conduit pass.

According to a further aspect of the present invention there is provided a liquid dispensing system including at least:

the integrated heat exchanger and liquid dispensing unit according to the first aspect of the present invention;

a remotely located temperature control system for providing a supply of said heat transfer fluid;

a remotely located liquid supply for supplying said liquid;

a heat transfer fluid delivery line coupled between said temperature control system and said inlet for supplying heat transfer fluid from said temperature control system to said integrated dispenser and heat exchanger unit;

a heat transfer fluid return line providing fluid communication between said outlet and said temperature control system; and a liquid delivery line providing fluid communication between said liquid supply and said conduit; whereby, in use, said heat transfer fluid is continuously circulated through said temperature control system and said fluid flow path.

Preferably said liquid dispensing system further includes a substantially planar support surface on which said integrated heat exchanger and liquid dispensing unit is wholly disposed.

Preferably said planar support surface is provided with one or more apertures through which said inlet and outlet of said fluid flow path and said inlet of said conduit pass for coupling to said heat transfer delivery line, said heat transfer return line, and said liquid delivery line respectively.

According to a further aspect of the present invention there is provided a method of cooling and dispensing draught beer at a bar or counter of an establishment comprising the steps of:

providing a heat exchanger and liquid dispensing unit according to the first aspect of the present invention;

mounting said unit to be wholly supported on said bar or counter;

coupling said internal fluid flow path to a circulating flow of heat transfer fluid;

coupling said conduit to a supply of beer, and operating said dispensing valve to dispense beer from said unit.

BRIEF DESCRIPTION OF THE DRAWINGS

Embodiments of the present invention will now be described by way of example only with reference to the accompanying drawings in which.

DETAILED DESCRIPTION OF PREFERRED EMBODIMENTS

Figure 3:
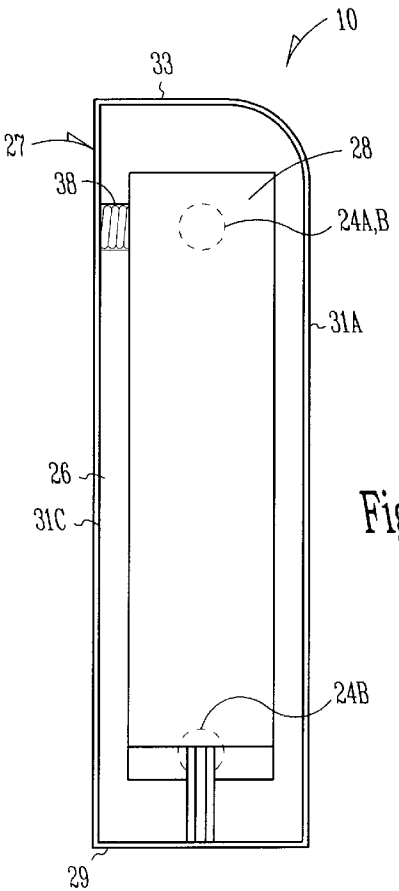
FIG. 3 is a side view of the heat exchanger shown in FIG. 1.
Figure 2:
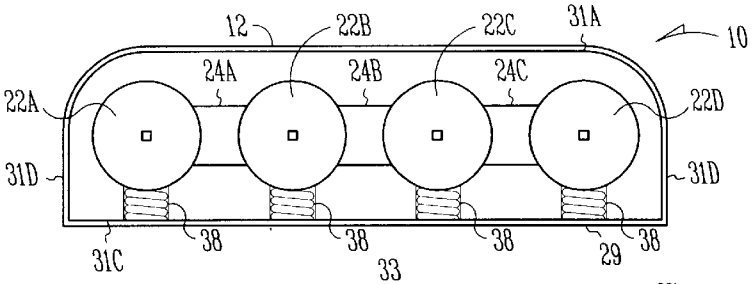
FIG. 2 is a plan view of the heat exchanger shown in FIG. 1.
Figure 1:
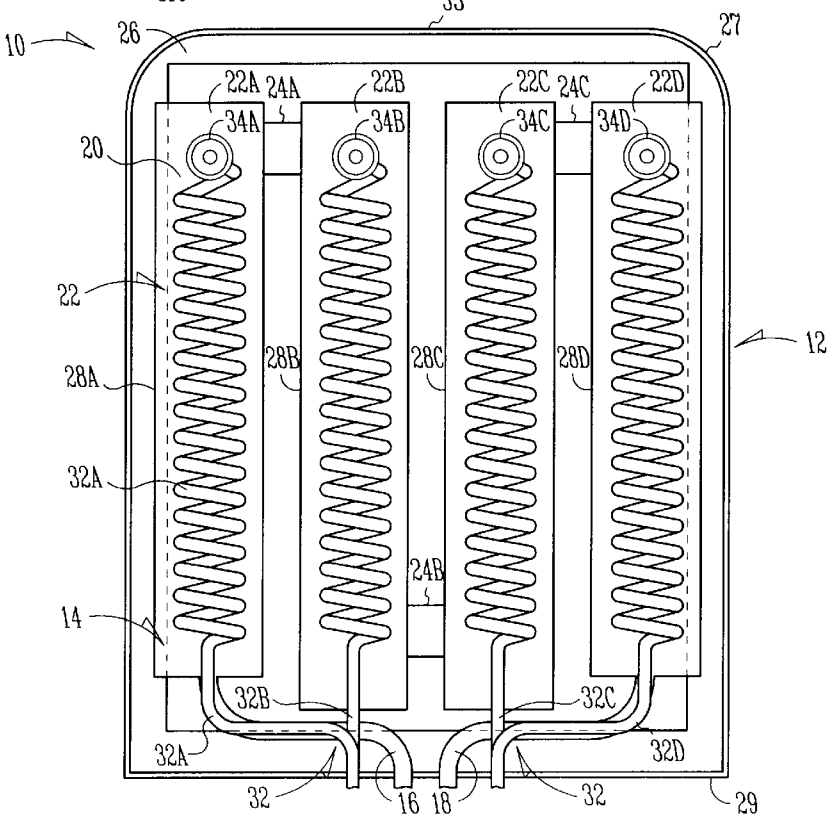
FIG. 1 is a schematic representation of the internals of an integrated heat exchanger and liquid dispensing unit in accordance with the present invention from the front.

Referring to FIGS. 1–4, it can be seen that the integrated heat exchanger and liquid dispensing unit 10 for the flash cooling of liquid such as beer includes a main body 12 provided with an internal fluid flow path 14 having an inlet 16, an outlet 18, and a void 20 in fluid communication therebetween. In this particular embodiment, the void 20 comprises four cylindrical chambers 22A, 22B, 22C and 22D (referred to in general as "chambers 22") that are interlinked so as to be in mutual fluid communication with each other. This is achieved by the provision of a channel 24A between respective upper ends of cylindrical chambers 22A and 22B, channel 24B between respective lower ends of adjacent cylindrical chambers 22B and 22C, and channel 22D between respective upper ends of adjacent cylindrical chambers 22C and 22D.

The main body 12 is composed of an inner thermal insulating block 26 and an outer housing 27. The void 20 and constituent chambers 22 are formed within the block 26. The chambers 22A–22D are lined with rigid sleeves 28A–28D (referred to in general as "sleeves 28") respectively. Typically the sleeves 28 will be made from stainless steel. The channels 24 are constituted by short lengths of stainless steel tubing interconnecting the adjacent sleeves 28.

A separate conduit 30A–30D (referred to in general as "conduits 30") is disposed within respective chambers 22A–22D. Each conduit 30 has a coiled length so as to maximise the physical length of each conduit 30 within each chamber 22. Each conduit 30 has an inlet 32 leading to the outside of the main body 12. An opposite end of each conduit 30 forms an outlet 34 via which a liquid passing through the conduit 30 can be expelled from the main body 12. Typically each inlet 32 would be coupled to a different keg of beer.

Figure 5:
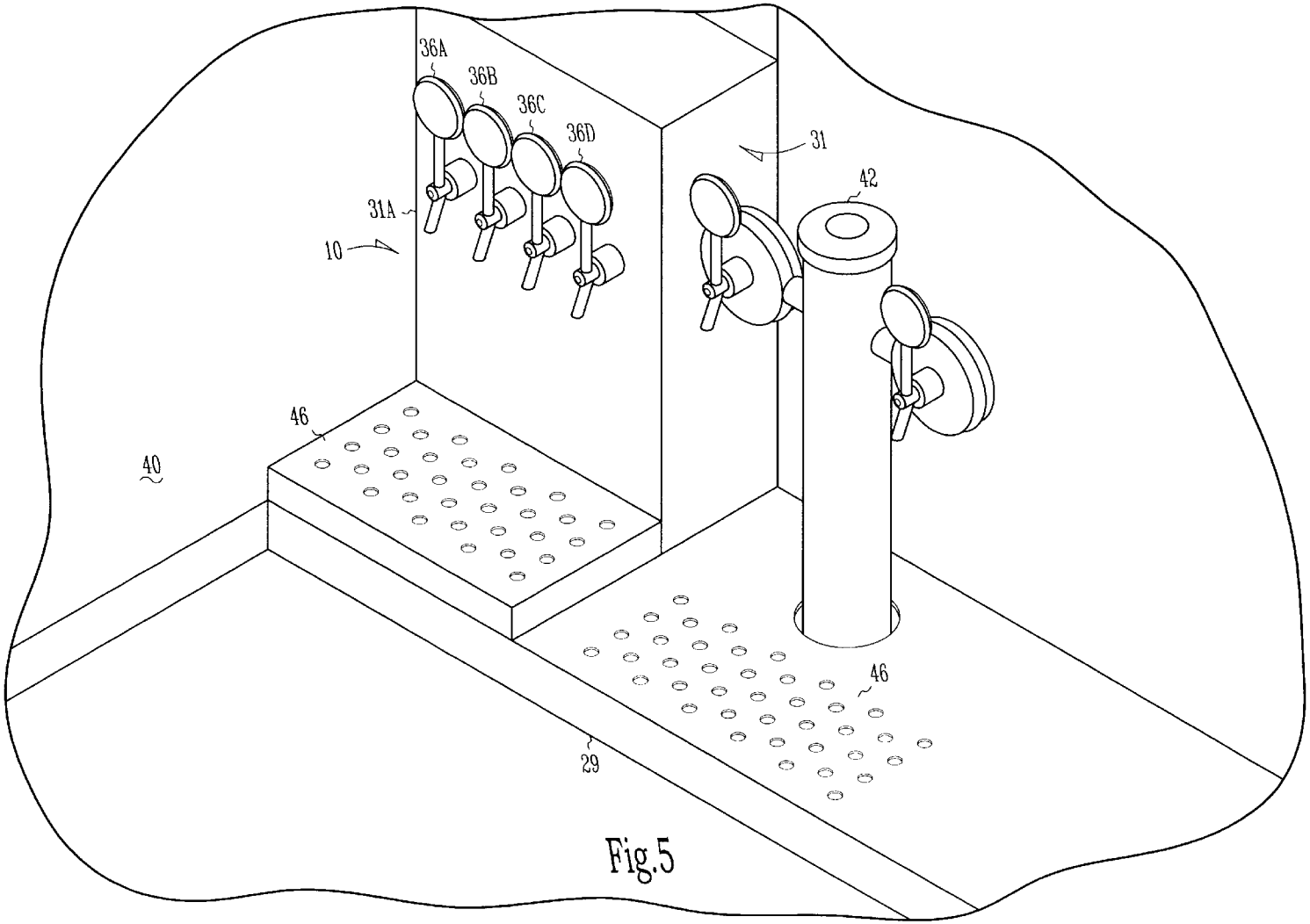
FIG. 5 is a perspective view of an embodiment of the integrated heat exchanger and liquid dispensing unit in accordance with this invention adjacent a prior art font of a conventional heat exchanging system.

Respective dispensing valves in the form of taps 36A–36D (referred to in general as "taps 36") are coupled to the respective outlets 34 of each conduit 30. As shown in FIG. 5, the taps 36 are supported on the main body 12.

Adaptors 38 are coupled between respective sleeves 28 and the housing 27. The adaptors 38 are provided with screw threads to facilitate attachment of corresponding taps 36. The outlet 34 of each conduit 30 is welded to a corresponding adaptor 38. In this way, the taps 36 are effectively directly coupled to the coils 30.

The main body 12 (and thus housing 27) is in the general shape of a rectangular prism and has a base 29; side wall 31 composed of four panels 31*a*, 31*b*, 31*c* and 31*d*; and top wall 33. The inlet 16, outlet 18 and inlets 32 extend through the base 29 (see in particular, FIG. 4) to allow coupling with appropriate lines/hoses.

Figure 4:
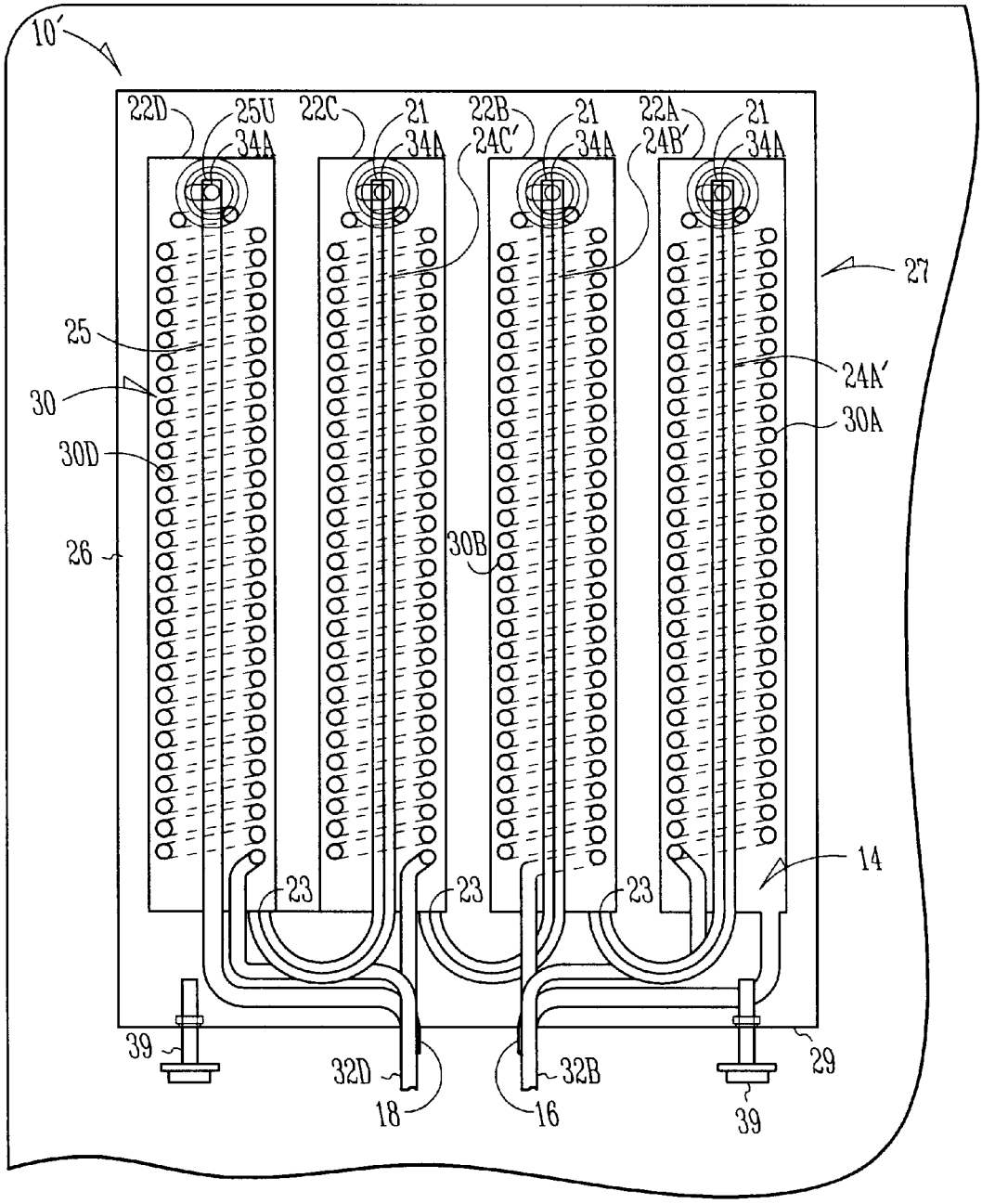
FIG. 4 is a schematic representation of a second embodiment of the integrated heat exchanger and liquid dispensing unit.

FIG. 4 depicts an alternate embodiment of the unit 10' where the same features are denoted by the same reference numbers but where modified features are indicated by the addition of the prime symbol. Unit 10' differs from the unit 10 depicted in FIGS. 1–3 solely by virtue of the coupling between chambers 22. In the unit 10 this coupling is effected by the provision of channels 24 in the form of short links of tube extending transversely between adjacent chambers 22. However in the unit 10', the connection is by way of J-shaped tubes 24'*a*, 24'*b* and 24'*c* (hereinafter referred to in general as J-tubes 24'). Each J-tube 24 has an upper end 21 and a lower end 23. The "long end" of each J-tube 24' extends axially through the coiled conduit 30 of its corresponding chamber 22. Mutually adjacent chambers 22 are placed in fluid communication with each other by coupling with respective J-tubes 24' with the J-tubes 24' arranged so that upper end 21 is disposed in an upstream chamber 22 with lower end 23 disposed in an adjacent downstream chamber 22. Each J-tube 24' is dimensioned so that the upper end 21 is disposed near an upper end of the chamber 22 in which it is disposed, and more particularly in the vicinity of the outlet 34 of the conduit 30 disposed within that chamber 22.

In the unit 10', the inlet 16 is coupled to the chamber 22*a* and the outlet 18 coupled to the chamber 22*d*. Therefore in terms of the flow of heat transfer fluid through the fluid flow path 14, chamber 22*a* is upstream of chamber 22*b* which is upstream of chamber 22*c* which in turn in upstream of chamber 22*d*. Upper end 21 of J-tube 24*a'* is disposed in chamber 22*a* with lower end 23 of J-tube 24*a'* disposed in the adjacent downstream chamber 24*b*. Similarly, the upper end of J-tube 24*b'* is in chamber 22*b* with lower end in chamber 22*c;* and, upper end of J-tube 24*c'* is disposed in chamber 22*c* and the lower end of J-tube 24*c'* disposed in chamber 22*d*. The outlet 18 is formed at one end of a tube 25 which has an opposite upper end 25*u* located near the upper end of chamber 22*d* and more particularly in the vicinity of the outlet 34 of the conduit 30 disposed within chamber 22*d*. The above described interconnecting of the chambers 22 by the J-tubes 24' provides an alternate method of flooding the chambers 22. It will be appreciated that the heat transfer fluid passing in through the inlet 16 can only pass out of the outlet 18 once all of the chambers 22 are filled to a level adjacent the upper ends 23 of the J-tubes 24' and the upper end 25*u* of tube 25.

FIG. 4 also shows two bolts 39 that screw into the base 29 of housing 27 to bolt the unit 10' to a bar or serving counter.

Figure 6:
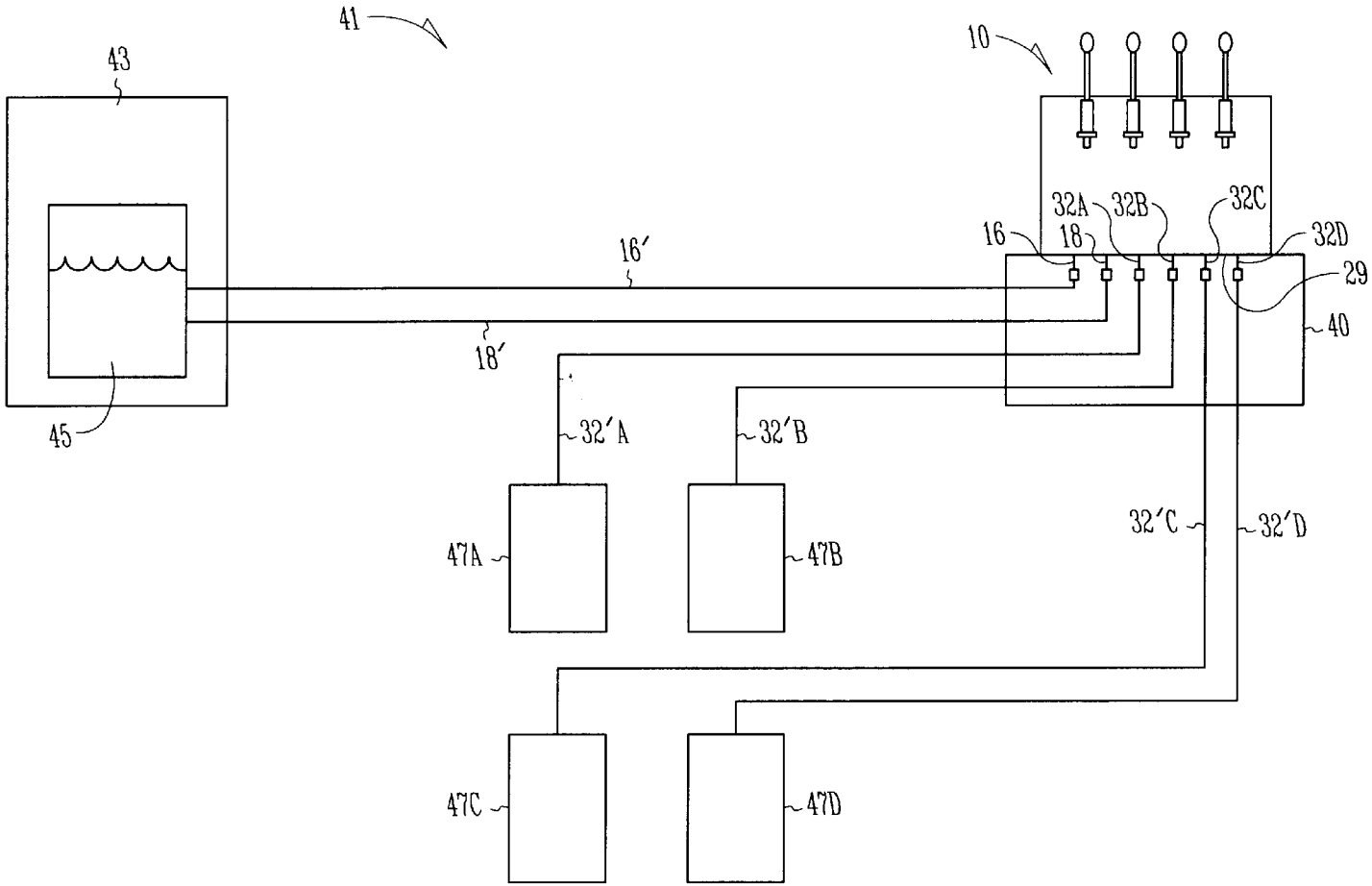
FIG. 6 is a schematic representation of a liquid dispensing system in accordance with the present invention.

FIGS. 5 and 6 depict the heat exchanger unit 10, incorporated into a liquid dispensing system 41. The liquid dispensing system 41 includes a planar support surface such as a bar or serving counter 40 on which the unit 10 is supported. More particularly, the unit 10 rests or sits on its base 29 on the bar 40. The bar 40 is provided with one or more apertures through which the inlet 16, outlet 18, and inlets 32*a*–32*d* pass for connection with corresponding lines/hoses. Bolt holes are also formed in the bar 40 to register with fixing points in the base 29 so that the bolts 39 (refer FIG. 4) can fasten the unit 10 to the bar 40. The system 41 includes a temperature control system in the form of cool room 43 for providing heat transfer fluid, such as liquid 45 at a predetermined temperature. A delivery line 16' is coupled between the cool room 43 and the inlet 16 via a coupling C. The heat transfer liquid 45 is returned to the cool room 43 by a return line 18' connected between the outlet 18 and the cool room 43 via coupling C. Kegs 47*a*–47*d* are connected via corresponding delivery lines 32*a'*–32*d'* and couplings C to the inlets 32*a*–32*d*.

The heat transfer liquid 45 flows continuously through the unit 10. In this embodiment, the fluid flow path 14 is a single direct path that contains no branches or diversion paths so that all of the liquid 45 that enters through the inlet 16 passes through the void 20 (i.e. through all the chambers 22) prior to exiting from the outlet 18. The flow path 14 does not include any valve or any control means for adjusting or controlling the flow of the fluid 45 through the unit 10.

When a tap 36 is open, beer from a keg 47 passes through a line 32', inlet 32, conduit 30 and corresponding outlet 34. The beer is chilled during its passage through the conduit 30 by virtue of the direct contact between the liquid 45 and the conduit 30 within a particular chamber 22.

FIG. 5 depicts and embodiment of the heat exchanger 10 alongside a traditional two tap beer font 42. It can be seen that in general terms the foot print or area occupied by the heat exchanger 10 having four taps 36 is approximately the same as the two tap font 42. However, beneath the font 42 will typically be a prior art heat exchanger the type described in the background to this invention in the form of an aluminium block with coolant coils and beer coils. The heat exchanger of the prior art would occupy substantially all of the space immediately below the font 42. Riser lines would connect the beer coils from the heat exchanger to the font 42 shown in FIG. 4 together with other fonts that may be disposed along the bar 40. Further, it can be seen that a spill tray 46 is laid in the bar 40 beneath the font 42. In contrast, the heat exchanger 10 facilitates the use of an above bar spill tray 48 thus avoiding the need to alter the structure of the bar 40. As beer is poured directly from the chilled conduits 30, wastage associate with stale or old beer in riser lines between the prior art heat exchangers and the font 42 is eliminated. Also, in terms of cleaning, by simply unscrewing the taps 36, the entire beer line from the keg to the tap 36 can be cleaned with a conventional abrasive foam bullet air blasted through the beer line including the conduit 30. As previously mentioned, it is practically impossible to clean the portion of the beer line in the prior art from the beginning of the riser lines at the end of the heat exchanger to the taps of the font 42. Embodiments of the system 10 also allow greater control over temperature of the liquid being dispensed. This is because the variations in temperature that are associated with the use of riser lines is eliminated. Further, when designing beer dispensing systems, it is necessary to take account of all sources of heat loss. When using a font 42, the heat loss is taken to be in the order of 400 watts. Experiments indicate that embodiments of the heat exchanger 10 would only use approximately 80 watts. Additionally, because embodiments of the heat exchanger 10 do not require the use of riser lines, there is a reduction in the number of possible leak points along the beer line from the keg to the tap.

Now that an embodiment of the heat exchanger 10 has been described in detail it will be apparent to those skilled in the relevant arts and numerous modification and variations may be made without departing from the basic inventive concepts. For example, the illustrated embodiment show a four tap heat exchanger 10 with four separate chambers 22 and corresponding coils or conduits 30. However, the void 20 can be divided into any number of separate interlinked chambers 22. Further, more than one coil can be placed in a single chamber 22. Also, the method of coupling adjacent chambers 22 can change from the serpentine like interconnection shown in FIG. 1. For example, adjacent chambers 22 can be coupled at their lower ends and the outlet 18 can be coupled with an upper end of the last chamber 22D to ensure that the refrigerant fluid can only pass to the outlet 18 after completely filling all of the chambers 22. Additionally, the main body 12 can be made from shapes other than rectangular blocks as depicted. Further, various decals and/or advertising carriers of various shapes and configurations can be attached to the main body 12. Also with reference to the embodiment shown in FIG. 6 the temperature control room 43 can be replaced with any other known type of temperature control system such as a conventional chiller.

While the embodiment has been described in relation to the dispensing of beer, it can of course be used for dispensing other liquids such as carbonated or non carbonated soft drinks or liquids or chemicals other than drinks. Further, the heat exchanger 10 can be used for heating rather than cooling a liquid. Whether or not the apparatus 10 is used for heating or cooling is solely dependent on the nature of the fluid passing through the fluid flow path 14. In one embodiment the inner thermal insulating block 26 is made from a polyurethane injected foam and the outer housing 27 made from stainless steel. However other materials can be used that perform the same function as the block 26 and housing 27.

All such modifications and variations together with others that would be obvious to a person of ordinary skill in the art are deemed to be within the scope of the present invention the nature of which is to be determined from the above description and the appended claims.

We claim:

1. An integrated heat exchanger and liquid dispensing unit for the flash cooling or heating and dispensing of a liquid, said unit including at least:

a main body including a block of thermal insulating material, the main body having an internal fluid flow path having an inlet, an outlet and a void disposed in fluid communication between said inlet and said outlet said void being formed in said block;

a conduit, at least a length of which is disposed in said void, said conduit having an inlet to admit a liquid into said conduit and an outlet at an end of said length to expel the liquid; and, a dispensing valve coupled to said outlet of said conduit and supported on said main body for dispensing said liquid; said fluid flow path is adapted to flow a heat transfer fluid in direct contact with said length of said conduit to effect heat transfer between said heat transfer fluid and a liquid passing through said conduit, changing the temperature of said liquid while said liquid is dispensed directly from the main body via the dispensing valve.

2. The unit according to claim 1 wherein said main body further includes an outer housing which houses the thermal insulating block and wherein the dispensing valve is demountably attached to said housing.

3. The unit according to claim 1 wherein said void is lined with a rigid sleeve.

4. The unit according to claim 2 further including an adaptor attached between said sleeve and said outer housing for coupling the outlet of said conduit to said dispensing valve.

5. The unit according to claim 1 wherein said main body has a base on which said unit sits when said unit is in use.

6. The unit according to claim 5 wherein said inlet and outlet of said fluid flow path and said inlets of conduits extend through said base.

7. The unit according to claim 1 wherein said fluid flow path is a single non-branched flow path whereby all of said heat transfer fluid flowing into said inlet of said fluid flow path flows through said void and flows out said outlet of said fluid flow path.

8. The unit according to claim 7 wherein said fluid flow path is free of valves or control means for controlling a rate of flow of said heat transfer fluid through said fluid flow path.

9. An integrated heat exchanger and liquid dispensing unit for flash cooling or heating and dispensing of a liquid, said unit including at least:

a main body including a block of thermal insulating material, the main body having an internal fluid flow path having an inlet, an outlet and a void disposed in fluid communication between said inlet and said outlet, said void being formed in said block;

a conduit, at least a length of which is disposed in said void, said conduit having an inlet to admit a liquid into said conduit and an outlet at an end of said length to expel the liquid;

a dispensing valve coupled to said outlet of said conduit and supported on said main body for dispensing said liquid; said fluid flow path is adapted to directly pass a heat transfer fluid in direct contact with said length of said conduit to effect heat transfer between said heat transfer fluid and a liquid passing through said conduit, changing the temperature of said liquid while said liquid is dispensed directly from the main body via the dispensing valve; and wherein said void includes a plurality of chambers, said chambers being in mutual fluid communication with each other so that said heat transfer fluid admitted through the inlet of the fluid flow path must flow through all of said chambers to exit through the outlet of said fluid flow path and said conduit is one of a plurality of separate conduits, each conduit having a length disposed in a corresponding chamber.

10. The unit according to claim 9 wherein each chamber is lined with a separate rigid sleeve.

11. A liquid dispensing system including at least:

an integrated heat exchanger and liquid dispensing unit according to claim 1, said main body having a base; and a substantially planar support surface on which said base sits and form which said liquid can be served.

12. The system according to claim 11 wherein said inlet and outlet of said fluid flow path and said inlet of said conduit extend through said base, and said planar support surface is provided with one or more apertures through which said inlet and outlet of said fluid flow path and said inlet of said conduit pass.

13. The system according to claim 12 wherein fluid flow path is a single non-branched flow path whereby all of said heat transfer fluid flowing into said inlet of said fluid flow path flows through said void and flows out said outlet of said fluid flow path.

14. The system according to claim 13 wherein said fluid flow path is free of valves or control means for controlling a rate of flow of said heat transfer fluid through said fluid flow path.

15. A liquid dispensing system including at least:

the integrated heat exchanger and liquid dispensing unit according to claim 1;

a remotely located temperature control system for providing a supply of said heat transfer fluid;

a remotely located liquid supply for supplying said liquid;

a heat transfer fluid delivery line coupled between said temperature control system and said inlet for supplying heat transfer fluid from said temperature control system to said integrated dispenser and heat exchanger unit;

a transfer fluid return line providing fluid communication between said outlet and said temperature control system; and a liquid delivery line providing fluid communication between said liquid supply and said conduit; whereby, in use, said heat transfer fluid is continuously circulated through said temperature control system and said fluid flow path.

16. The system according to claim 15 wherein said liquid dispensing system further includes a substantially planar support surface on which said integrated heat exchanger and liquid dispensing unit is wholly disposed.

17. The system according to claim 16 wherein said main body includes a base and said base sits on said planar support surface.

18. The system according to claim 17 wherein said planar support surface is provided with one or more apertures through which said inlet and outlet of said fluid flow path and said inlet of said conduit pass for coupling to said heat transfer delivery line, said heat transfer return line, and said liquid delivery line respectively.

19. A method of cooling and dispensing draught beer at a bar or counter of an establishment comprising:

providing a heat exchanger and liquid dispensing unit according to claim 1;

mounting said unit to be wholly supported on said bar or counter;

coupling said internal fluid flow path to a circulating flow of heat transfer fluid;

coupling said conduit to a supply of beer;

directly contacting the heat transfer fluid to the outside of said conduit; and operating said dispensing valve to dispense beer from said unit.

20. The unit according to claim 9, wherein said main body further includes an outer housing which houses the thermal insulating block and wherein the dispensing valve is demountably attached to said housing.

21. The unit according to claim 20, further including an adaptor attached between said sleeve and said outer housing for coupling the outlet of said conduit to said dispensing valve.

22. The unit according to claim 9, wherein said main body has a base on which said unit sits when said unit is in use.

23. The unit according to claim 22, wherein said inlet and outlet of said fluid flow path and said inlets of conduits extend through said base.

24. The unit according to claim 9, wherein said fluid flow path is free of at least one of a valve and control means for controlling a rate of flow of said heat transfer fluid through said fluid flow path.

25. A liquid dispensing system including at least:

an integrated heat exchanger and liquid dispensing unit according to claim 9, said main body having a base; and a substantially planar support surface on which said base sits and form which said liquid can be served.

26. The system according to claim 25 wherein said inlet and outlet of said fluid flow path and said inlet of said conduit extend through said base, and said planar support surface is provided with one or more apertures through which said inlet and outlet of said fluid flow path and said inlet of said conduit pass.

27. The system according to claim 26 wherein said fluid flow path is free of at least one of a valve and control means for controlling a rate of flow of said heat transfer fluid through said fluid flow path.

28. A liquid dispensing system including at least:

the integrated heat exchanger and liquid dispensing unit according to claim 9;

a remotely located temperature control system for providing a supply of said heat transfer fluid;

a remotely located liquid supply for supplying said liquid;

a heat transfer fluid delivery line coupled between said temperature control system and said inlet for supplying heat transfer fluid from said temperature control system to said integrated dispenser and heat exchanger unit;

a heat transfer fluid return line providing fluid communication between said outlet and said temperature control system; and a liquid delivery line providing fluid communication between said liquid supply and said conduit; whereby, in use, said heat transfer fluid is continuously circulated through said temperature control system and said fluid flow path.

29. The system according to claim 28, wherein said liquid dispensing system further includes a substantially planar support surface on which said integrated heat exchanger and liquid dispensing unit is wholly disposed.

30. The system according to claim 29, wherein said main body includes a base and said base sits on said planar support surface.

31. The system according to claim 30, wherein said planar support surface is provided with one or more apertures through which said inlet and outlet of said fluid flow path and said inlet of said conduit pass for coupling to said heat transfer delivery line, said heat transfer return line, and said liquid delivery line respectively.

32. A method of cooling and dispensing draught beer at a bar or counter of an establishment comprising:

providing a heat exchanger and liquid dispensing unit according to claim 9;

mounting said unit to be wholly supported on said bar or counter;

coupling said internal fluid flow path to a circulating flow of heat transfer fluid;

coupling said conduit to a supply of beer;

directly contacting the heat transfer fluid to the outside of said conduit; and operating said dispensing valve to dispense beer from said unit.

33. An integrated heat exchanger and liquid dispensing unit, comprising:

a main body including a block of thermal insulating material, the main body having an internal fluid flow path having an inlet, an outlet and a void disposed in fluid communication between said inlet and said outlet, said void being formed in said block, said inlet connected to a supply of a heat transfer fluid which fills said void;

a conduit, at least a length of which is disposed in said void, said conduit having an inlet to admit a liquid into said conduit and an outlet at an end of said length to expel the liquid, said heat transfer fluid being in direct contact with said length of said conduit; and a dispensing valve coupled to said outlet of said conduit.

34. The unit according to claim 33, wherein said main body further includes an outer housing which houses the thermal insulating block, and wherein the dispensing valve is demountably attached to said outer housing.

35. The unit according to claim 33, wherein said void is lined with a rigid sleeve.

36. The unit according to claim 33, wherein said void is lined with a rigid sleeve, wherein said main body further includes an outer housing which houses the thermal insulating block, and wherein the main body further includes an adaptor attached between said sleeve and said outer housing for coupling the outlet of said conduit to said dispensing valve.

37. The unit according to claim 33, wherein said main body has a base on which said unit sits with said unit being in use.

38. The unit according to claim 37, wherein said inlet and said outlet of said fluid flow path and said inlets of conduits extend through said base.

39. The unit according to claim 33, wherein said fluid flow path is a single non-branched flow path whereby all of said heat transfer fluid flowing into said inlet of said fluid flow path flows through said void and flows out said outlet of said fluid flow path.

40. The unit according to claim 39, wherein said fluid flow path is free of at least one of a valve and control means for controlling a rate of flow of said heat transfer fluid through said fluid flow path.

41. The unit according to claim 33, wherein said void includes a plurality of chambers, said chambers being in mutual fluid communication with each other so that said heat transfer fluid admitted through the inlet of the fluid flow path must flow through all of said chambers to exit through the outlet of said fluid flow path and said conduit includes a plurality of separate conduits, each conduit having a length disposed in one of the plurality of chambers.

42. The unit according to claim 41, wherein each chamber is lined with a separate rigid sleeve.

* * * * *